US005961674A

United States Patent [19]

Gagliardi et al.

[11] Patent Number: 5,961,674

[45] Date of Patent: Oct. 5, 1999

[54] ABRASIVE ARTICLE CONTAINING AN INORGANIC METAL ORTHOPHOSPHATE

[75] Inventors: John J. Gagliardi, Hudson, Wis.; Charles H. Houck, Oakdale, Minn.

[73] Assignee: 3M Innovative Properties Company, St. Paul, Minn.

[21] Appl. No.: 08/942,731

[22] Filed: Oct. 2, 1997

Related U.S. Application Data

[63] Continuation of application No. 08/545,871, Oct. 20, 1995, abandoned.

[51] Int. Cl.[6] ..... B24D 11/02; B32B 5/16

[52] U.S. Cl. ..... 51/295; 51/297; 51/298; 51/309; 428/330; 428/413; 428/524; 428/525; 523/149; 523/440; 523/451

[58] Field of Search ..... 428/330, 413, 428/524, 525; 51/295, 297, 298, 309; 523/149, 440, 451

[56] References Cited

U.S. PATENT DOCUMENTS

| | | | |
|---|---|---|---|
| 2,216,135 | 10/1940 | Rainier | 51/298 |
| 2,243,049 | 5/1941 | Kistler et al. | 51/295 |
| 2,408,319 | 9/1946 | Kistler | 51/307 |
| 2,690,385 | 9/1954 | Richlin | 51/294 |
| 2,811,430 | 10/1957 | Gregor et al. | 51/298 |
| 2,939,777 | 6/1960 | Gregor et al. | 51/298 |
| 2,949,351 | 8/1960 | Vigliatura, Jr. | 51/298 |
| 2,952,529 | 9/1960 | Stone | 51/298 |
| 3,030,198 | 4/1962 | Kibbey | 51/298 |
| 3,032,404 | 5/1962 | Douglass et al. | 51/298 |
| 3,246,970 | 4/1966 | Zimmerman | 51/298 |
| 3,502,453 | 3/1970 | Baratto | 51/295 |
| 3,770,401 | 11/1973 | Sheets, Jr. et al. | 51/295 |
| 4,420,532 | 12/1983 | Yamaguchi et al. | 428/329 |
| 4,770,671 | 9/1988 | Monroe et al. | 51/293 |
| 4,895,675 | 1/1990 | Smith | 252/539 |
| 4,920,704 | 5/1990 | Caserta et al. | 51/302 |
| 5,009,674 | 4/1991 | Kunz et al. | 51/295 |
| 5,011,512 | 4/1991 | Wald et al. | 51/295 |
| 5,026,404 | 6/1991 | Kunz et al. | 51/295 |
| 5,061,295 | 10/1991 | Hickory et al. | 51/298 |
| 5,078,753 | 1/1992 | Broberg et al. | 51/298 |
| 5,096,983 | 3/1992 | Gerber | 525/506 |
| 5,116,392 | 5/1992 | Selgrad et al. | 51/309 |
| 5,441,549 | 8/1995 | Helmin | 51/298 |

FOREIGN PATENT DOCUMENTS

| | | | |
|---|---|---|---|
| 0 071 723 A3 | 2/1983 | European Pat. Off. | B24D 3/28 |
| 2657881 | 6/1978 | Germany . | |
| 487287 | 6/1938 | United Kingdom . | |
| 826729 | 1/1960 | United Kingdom . | |
| 994484 | 6/1965 | United Kingdom . | |

OTHER PUBLICATIONS

Patent Abstracts of Japan, vol. 17, No. 142, AN. 92–418273 for Japanese Patent No. JP4311772 (published Nov. 4, 1992).

Patent Abstracts of Japan, vol. 13, No. 163, AN. 89–051876 for Japanese Patent No. JP64002868 (published Jan. 6, 1989).

Derwent Abstract AN. 77–80174Y for Japanese Patent No. 52115493 (published Sep. 28, 1977).

Derwent Abstract AN. 93–141620 for Patent No. SU 1731795 (published May 7, 1992).

Patent Abstracts of Japan, vol. 12, No. 466, AN. 88–261767 for Japanese Patent No. JP3191574, Aug. 9, 1988.

Kirk–Othmer Encyclopedia of Chemical Technology, 4th Edition, vol. 1, pp. 28–29 (1991).

Kirk–Othmer Encyclopedia of Chemical Technology, 3rd Edition, vol. 1, pp. 29–31, (1978).

I. S. Hong et al., "Coated Abrasive Machining of Titanium Alloys With Inorganic Phosphate Solutions", Trans. ASLE, 14 (1971) pp. 8–11.

Cadwell et al., "Grinding a Titanium Alloy With Coated Abrasives", ASME Paper 58–SA–44, Jun. 1958.

*Primary Examiner*—Randy Gulakowski

*Attorney, Agent, or Firm*—Paul W. Busse; Scott R. Pribnow

[57] ABSTRACT

An abrasive article, and methods of making and using same, containing an inorganic metal orthophosphate salt. The abrasive article including a coated abrasive article having a size or supersize coating layer containing an alkali metal or alkaline earth metal orthophosphate salt devoid of hydrogen. The inventive abrasive article reduces the grinding energy required while improving abrading efficiency in some cases.

14 Claims, No Drawings

ABRASIVE ARTICLE CONTAINING AN INORGANIC METAL ORTHOPHOSPHATE

This is a continuation of application Ser. No. 08/545,871, filed Oct. 20, 1995 now abandoned.

BACKGROUND OF THE INVENTION

1. Field of the Invention

This invention relates to abrasive products comprising abrasive particles, binder, and an inorganic metal orthophosphate salt, and to methods of making and using same. These abrasive products include bonded abrasives, coated abrasives, and nonwoven abrasives.

2. Description of the Related Art

In the competitive and economically significant field of abrasive products, a continuing desire exists to reduce manufacturing costs and increase performance of such products in efforts to seek and acquire competitive edge.

Abrasive products are generally known having abrasive particles adherently bonded to a sheet-like backing. It is generally known to stratify the abrasive grains and binders into separate layers that are serially formed upon a sheet-form substrate, such as in coated abrasive articles, in such a way as to basically segregate the abrasive grains as a particulate monolayer sandwiched between underlying and overlaying binder layers.

More specifically, coated abrasive products typically have a backing substrate, abrasive grains, and a bonding system which operates to hold the abrasive grains to the backing. In a typical coated abrasive product, the backing is first coated with a layer of adhesive, commonly referred to as a "make coat", and then the abrasive grains are applied to the adhesive coating. The application of the abrasive grains to the make coat involves electrostatic deposition or a mechanical process which maximizes the probability that the individual abrasive particles are positioned with its major axis oriented perpendicular to the backing surface. As so applied, the abrasive particles optimally are at least partially embedded in the make coat. The resulting adhesive/abrasive grain layer is then generally solidified or set (such as by a series of drying or curing ovens) sufficient to retain the adhesion of abrasive grains to the backing. After curing or setting the make coat, a second layer of adhesive, commonly referred to as a "size coat", is applied over the surface of the make coat and abrasive particles, and, upon setting, it further supports the particles and enhances the anchorage of the particles to the backing. Optionally, a "supersize" coat, which may contain grinding aids, can be applied over the cured size coat. In any event, once the size coat and supersize coat, if used, has been cured, the resulting coated abrasive product can be converted into a variety of convenient forms such as sheets, rolls, belts, and discs. As an optional supersize enhancement, to mitigate any anticipated loading or clogging of the abrasive product with swarf (i.e., debris liberated from the workpiece during the abrading operation), a coating of anti-stick stearate also can be applied as supersize over the exterior of the abrasive coating, once formed, as suggested in *Kirk-Othmer Encyclopedia of Chemical Technology*. Fourth Ed., Vol. 1, (P. 29).

In many abrasive articles the binder includes a particulate filler as an adjuvant. Typically, the binder will comprise between 40 to 70 percent by weight particulate filler. The addition of the filler either increases the toughness and hardness of the binder and/or reduces the cost of the finished article, e.g., by decreasing the amount of binder required. The filler is typically an inorganic particulate material, generally having a particle size less than about 40 micrometers. Examples of common fillers in the abrasive industry include calcium carbonate, calcium oxide, calcium metasilicate, alumina trihydrate, silica, kaolin, quartz, and glass.

There exists a subclass of fillers, referred to as grinding aids, cutting aids, or generically as "active fillers". An active filler is typically a particulate material the addition of which to the binder has a significant affect on the chemical and physical processes of abrading which leads to improved performance. It is believed that active fillers will either (1) decrease the friction between the abrasive grains and the workpiece being abraded, and/or (2) prevent the abrasive grains from "capping", i.e. prevent metal particles from becoming welded to the tops of the abrasive grains, and/or (3) decrease the interface temperature between the abrasive grains and the workpiece, and/or (4) decrease the required grinding force.

Grinding aids can be especially effective in abrading stainless steel, exotic metal alloys, titanium, metals slow to oxidize, and so forth. In some instances, a coated abrasive product containing a grinding aid in the binder can abrade up to 100% more stainless steel than a corresponding coated abrasive product in which the binder is devoid of a grinding aid. The reason, in theory, being that the activity of grinding metal by abrasive articles produces freshly formed, hot, and uncontaminated metal surfaces. If the newly formed, uncontaminated metal surface is not rapidly "contaminated", metal will transfer and adhere to the abrasive particle surface(s) causing "capping" which decreases grinding performance. One purpose and function of grinding aids is to prevent capping by rapidly contaminating the freshly formed metal surface. Grinding aids are normally incorporated into the bond resin(s) of the abrasive article. Grinding aids (active fillers) can be classified as physically active or chemically active. Cryolite, sodium chloride, and potassium tetrafluoroborate are known physically active grinding aids that melt between 500 and 1,000° C. which can form thin films on freshly formed metal. Chemically active grinding aids include iron pyrite, polyvinyl chloride, and polyvinylidene chloride which decompose when heated forming chemicals that rapidly react with the freshly formed metal surface.

Also, combinations of grinding aids in abrasive articles (grinding wheels) may produce more than a cumulative grinding effect. U.S. patents describing use of the combination of a sulfide salt and an alkali metal salt include U.S. Pat. Nos. 2,408,319; 2,811,430; 2,939,777; 3,246,970; and 5,061,295. Other patents that combine an inorganic salt containing fluorine, e.g. cryolite, and a salt such as ammonium chloride include U.S. Pat. Nos. 2,949,351 and 2,952,529.

Another type of grinding aid enhancement is described in U.S. Pat. No. 5,441,549 (Helmin) wherein the grinding aid effect of potassium tetrafluoroborate is enhanced by the addition of specific thermoplastics.

Other descriptions of grinding aids include:

U.S. Pat. No. 2,216,135 (Rainier), which teaches a grinding wheel having as a grinding aid an anhydrous, water-soluble non oxidizing inorganic alkali or alkaline earth metal salts whose melting points are within the range of 700 to 1200° C. These materials include sodium chloride, potassium chloride, anhydrous sodium carbonate, sodium sulfate, potassium sulfate, lithium sulfate, sodium pyrophosphate, potassium pyrophosphate, calcium chloride, calcium bromide, magnesium sulfate, barium chloride, barium bromide, magnesium chloride, magnesium bromide or strontium chloride.

U.S. Pat. No. 2,243,049 (Kistler), which teaches an abrasive body (grinding wheels) containing finely divided strongly acidic or potentially acidic inorganic compounds. Acid sulfates, phosphates or pyrophosphates are satisfactory, as are the ammonium, sodium, potassium, calcium, or barium salts thereof Phosphorus pentoxide is also possible. The grinding aid constitutes about 7% of the bond. When used on metal work surfaces, the grinding aid reduces loading and increases the grain efficiency 40 to 100%.

U.S. Pat. No. 3,502,453 (Baratto) discloses abrasive articles containing hollow spherules filled with lubricant, which spherules rupture during grinding to release the lubricant. In one example, Baratto discloses a formulation molded into a wheel for titanium snagging, where the formulation includes silicon carbide, bonding resin, trisodium phosphate, and encapsulated lubricant.

U.S. Pat. No. 2,690,385 (Richlin), which teaches a metal cleaning cloth or felt impregnated with abrasive, sodium bisulfate and a humectant. Substitutes for the sodium bisulfate include ammonium chloride, ammonium phosphate, aluminum chloride, antimonious chloride, potassium bisulfate, oxalic acid, phosphoric acid and tartaric acid.

U.S. Pat. No. 3,030,198 (Kibbe), which discloses a grinding wheel containing potassium hexafluorophosphate as a grinding aid.

U.S. Pat. No. 3,032,404 (Douglass et al.), which discloses a grinding wheel containing as a grinding aid finely divided solid heavy metal phosphide. It is preferable to also include potassium aluminum fluoride in the grinding wheel.

U.S. Pat. No. 3,770,401(Sheets et al.), which describes an abrasive body (grinding wheel) comprised of grit-sized particles of alumina or silicon carbide held together by a water-insoluble aluminum phosphate bonding matrix.

U.S. Pat. No. 5,096,983 (Gerber), which teaches the use of up to 5.0% of a water soluble salt such as sodium phosphate to retard the room temperature and eventual hardening of phenolic resole resins which are mixed with magnesium oxide with or without an ester functional hardening agent.

U.S. Pat. No. 5,116,392 (Selgrad et al.), which teaches a grinding aid having the formula: $uM_1 \cdot M_2 \cdot wHal \cdot xChal \cdot zPh$, where $M_1$ is a pure metal or mixture of alkali metal, alkaline earth metal and/or Al; $M_2$ is a pure metal or mixture of Zn, Mn, Fe except for Fe as chloride; Hal is a pure halogen or mixture of F, Cl, Br, I; Chal is chalcogenides, O and/or S; Ph is phosphate or more highly condensed phosphates of the formula $P_rO_s$ where r=1 to 10, preferably 1 to 2, s=4 to 20, preferably 4 to 7; and u, v, w, x or z=0 to 95%.

Also, commonly assigned U.S. Pat. Appln. Ser. No. 08/214,394, filed Mar. 16, 1994, describes abrasive articles having a peripheral (outermost) coating comprised of grinding aid particles and a binder, where the grinding aid particles are individually coated with an inert, hydrophobic, hydrocarbon-containing substance. For coated abrasive articles, the peripheral coating is stated to refer to either the size or supersize coat that is the outermost coating on the abrasive surface of the article. The individually-coated grinding aid particles also may be incorporated into erodible grinding aid agglomerates, with a binder to adhere the grinding aid particles together, and these agglomerates can be incorporated into the make, size and/or supersize coats of a coated abrasive. Although a number of examples of grinding aid particles are disclosed in U.S. Appln. Ser. No. 08/214,394, alkali or alkaline earth metal phosphates are not named.

Commonly assigned U.S. Pat. Appln. Ser. No. 08/545,984 (Harmer et al.), filed on even date with the present application, describes abrasive articles having an alkali or alkaline earth metal metaphosphate, such as sodium metaphosphate, in the peripheral coating layer, and methods of making these abrasive articles, as well as a method of using them to grind titanium.

Commonly assigned U.S. Pat. Appln. Ser. No. 08/545,874 (Ho et al.), filed on even date with the present application, describes coated abrasive articles having an abrasive grain layer formed in a make coat, which, in turn, is coated with a size coat or a size coat and a super size coat, where the abrasive grain layer is comprised of abrasive grains and nonabrasive composite grains which contain inorganic nonabrasive particles bonded together by a metal salt of a fatty acid or colloidal silica, or combinations thereof.

Titanium alloys, in particular, such as those designed for aerospace applications and other applications where high strength to weight ratios are desirable, are extremely difficult to grind, even with conventional grinding aids. Although the high strength of these alloys is a major cause of poor grindability, chemical adhesion of the titanium to the abrasive grain is also thought a factor contributing to poor abrasive performance. These difficulties can be alleviated somewhat by use of certain grinding fluids, such as coolants or lubricants, used to flood the grinding interface between the abrasive article and workpiece. Materials used as grinding fluids for titanium include soluble cutting oils such as highly chlorinated cutting oils and buffered inorganic tripotassium phosphate solutions, the latter of which being described by I. S. Hong et al., "Coated abrasive machining of titanium alloys with inorganic phosphate solutions", Trans. ASLE, 14 (1971), pages 8–11. Additionally, a comparative study of grinding aid lubricants involving the use of among four inorganic salts $NaNO_2$, $KNO_2$, $Na_3PO_4$, and $K_3PO_4$, is described by CADWELL et al., "Grinding a titanium alloy with coated abrasives," ASME Paper 58-SA-44, June, 1958. Although widely used in buffered solutions, the tripotassium phosphate salts have proven difficult to incorporate into resin-bonded systems due to their hygroscopic nature.

U.S. Pat. No. 4,770,671 (Monroe et al.) describes adding various types of grinding aids onto the surface of alpha-alumina-based ceramic abrasive grits in coated abrasives. In one example, Monroe et al. describe $K_2HPO_4$ as a grinding aid.

A variety of "phosphates" exist as salts of acids of phosphorus. The conventional nomenclature and associated chemical formulae of several common anions for these salts include the following:

orthophosphate=$PO_4^{-3}$ monohydrogen orthophosphate=$HPO_4^{-2}$ dihydrogen orthophosphate=$H_2PO_4^{-1}$ metaphosphate=$PO_3^{-1}$ pyrophosphate=$P_2O_7^{-4}$.

This terminology is applicable for purposes of this application.

SUMMARY OF THE INVENTION

The present invention relates to abrasive articles containing an alkali or alkaline earth metal orthophosphate salt, which, in some abrading applications, require less energy to grind metal surfaces such as titanium while providing useful and even improved abrading efficiency. The alkali metal or alkaline earth metal orthophosphate salt is a compound devoid of hydrogen atoms. Thus, the present invention relates to an abrasive article comprising (a) a plurality of abrasive particles, (b) at least one binder to which said plurality of abrasive particles are adhered, and (c) a peripheral surface, said peripheral surface containing an inorganic metal phosphate salt devoid of hydrogen selected from the group consisting of an alkali metal orthophosphate salt and an alkaline earth metal orthophosphate salt.

In one aspect, the present invention provides coated abrasive articles having improved abrading efficacy and performance by containing an alkali metal or alkaline earth metal orthophosphate salt devoid of hydrogen in a peripheral coating layer thereof.

In a further aspect of this invention, there is a coated abrasive article including a substrate having abrasive grains adherently bonded thereto by at least one binding material, and a peripheral coating layer comprising an alkali metal or alkaline earth metal orthophosphate salt devoid of hydrogen.

Suitable inorganic alkali or alkaline earth metal orthophosphates devoid of hydrogen include those having high melting points such as tripotassium (ortho)phosphate ($K_3PO_4$)(m.p. 1340° C.), trisodium (ortho)phosphate ($Na_3PO_4$), or tribarium di(ortho)phosphate ($Ba_3(PO_4)_2$) (m.p. 1670° C.), or combinations thereof For purposes of this application, a "peripheral surface" means the outermost surface of an abrasive article, which represents the surface for contacting and abrading a workpiece. In the context of coated abrasive articles, a "peripheral coating" or "peripheral coating layer" is the outermost coating of a coated abrasive article, i.e. the coating having an exposed and uncoated major surface, as disposed on the working side of a coated abrasive article construction. The "working side" of the coated abrasive being a side of the construction where the abrasive grains are adherently bonded to the backing. The peripheral coating generally is a size coat, or a supersize coat, with the proviso that the layer in all cases represents the outermost layer of the abrasive article construction and is left uncoated by any other separate coating whether it is derived from the same composition or a different composition.

The peripheral coating layer containing the alkali metal or alkaline earth metal orthophosphate of the inventive abrasive article includes a binder, preferably a thermoset binder or resin, which serves as the continuous phase or medium by which the inorganic phosphate, and any other dispersed additives, are attached within and bound into the layer. The term "thermoset" resin, as used herein, means a cured resin that has been exposed to an energy source (e.g., heat and/or radiation) sufficient to make the resin incapable of flowing. The term "thermosetting" means an uncured thermoset resin. Also, the term "dispersed", or variants of this term, as used herein, does not necessarily denote a uniform distribution of the alkali metal or alkaline earth metal orthophosphate salt throughout the resinous binder of the coating layer, although uniform dispersions of such are contemplated in this invention.

In one preferred mode of the invention, a peripheral coating layer of the coated abrasive article of this invention containing the alkali metal or alkaline earth metal orthophosphate salt includes a binder that is an epoxy binder, an acrylic binder, or a phenolic binder. The preferred binder materials in this regard include a diglycidyl ether of bisphenol A epoxy resin and an amine-functional acrylic polymer.

Another advantage, in addition to reduction of energy required for grinding, attributable to the usage of the alkali metal or alkaline earth metal orthophosphate salt in a peripheral coating layer of an abrasive article includes avoiding the potential of halogens being liberated as from halogen-containing grinding aids.

In another aspect, the invention provides a method for making a coated abrasive article, comprising the steps of:

(a) applying a first binder resin precursor to a substrate;

(b) at least partially embedding a plurality of abrasive particles in said first binder resin precursor;

(c) at least partially curing said first binder resin precursor;

(d) applying a second binder resin precursor over said at least partially cured first binder resin precursor and said plurality of abrasive particles;

(e) at least partially curing said second binder precursor resin precursor;

(f) applying a third binder resin precursor and an inorganic metal phosphate salt devoid of hydrogen selected from the group consisting of an alkali metal orthophosphate and an alkaline earth metal orthophosphate; and (g) completely curing said first, second and third binder precursor resin precursors.

The third binder coating can be an aqueous-based system, such as with an acrylic/latex binder-based system, or a non-aqueous organic solvent based system, such as a xylene solvent-based epoxy binder system. Non-aqueous solvent-based systems are preferred. The present inventors have developed methods to successfully incorporate $K_3PO_4$ into binder systems of coated abrasive peripheral layers in manners effective to overcome and avoid the problems arising from the hygroscopic propensities of $K_3PO_4$.

The present invention, in another aspect, relates to a method of using the coated abrasive articles of the invention to grind titanium. Therefore, in one aspect the present invention relates to a method of using a coated abrasive article to grind titanium, comprising:

(a) providing a coated abrasive article comprising a plurality of abrasive particles, a binder to which said abrasive particles are adhered, and a peripheral coating layer containing an inorganic metal phosphate salt devoid of hydrogen selected from the group consisting of alkali metal orthophosphate salt and alkaline earth metal orthophosphate salt, and a workpiece comprising titanium;

(b) frictionally engaging said peripheral coating layer with a surface of said workpiece; and (c) moving at least one of said coated abrasive article and said workpiece relative to each effective to reduce the surface of said workpiece.

The coated abrasive articles of this invention are used in dry grinding operations without water flooding as the water may dissolve the alkali metal or alkaline earth metal orthophosphate-containing coating.

The incorporation of the alkali metal orthophosphate salt in a coating layer of the coated abrasive article of the present invention endows the coated abrasive article with an unexpected abrading efficiency when compared to a similar abrasive containing conventional grinding aids and fillers.

In yet another aspect of the invention, the abrasive article is a bonded abrasive comprising a shaped mass of the abrasive particles and the alkali metal or alkaline earth metal orthophosphate adhered together with a binder, which can be an organic, metallic or vitrified binder. By way of example, the shaped mass can be in the form of a grinding wheel or a conical shape. Thus, the present invention relates to a bonded abrasive article comprising a shaped mass having a peripheral surface, wherein said shaped mass comprises a plurality of abrasive particles and an inorganic phosphate salt adhered together by a thermosetting binder, said inorganic phosphate salt being devoid of hydrogen and selected from the group consisting of an alkali metal orthophosphate salt or an alkaline earth metal orthophosphate salt.

In another aspect of the invention, abrasive particles are provided as erodible abrasive agglomerates where the alkali metal or alkaline earth metal orthophosphate and abrasive grains are adhered together with a binder. The term "erodible", as used herein, means that the agglomerate has the ability to break down in a controlled manner, for example, by fracture due to mechanical stress. Thus, the present invention relates to an erodible grinding aid agglomerate comprising a plurality of particles of an inorganic metal phosphate salt devoid of hydrogen selected from the group consisting of alkali metal orthophosphate salt and alkaline earth metal orthophosphate salt, and a binder that adheres said inorganic metal phosphate salt particles together.

DETAILED DESCRIPTION OF THE PREFERRED EMBODIMENTS

The coated abrasive products of the present invention generally include conventional backings and binders for the coatings, and a peripheral coating layer containing an alkali metal or alkaline earth orthophosphate salt devoid of hydrogen. As will be shown, coated abrasive products of this invention have been found to demonstrate high performance in abrading workpieces such as titanium. The terminology "alkali metal", as used herein, refers to the Group IA metallic elements of the Periodic Table, viz., lithium, sodium, potassium, rubidium, cesium, and francium. Examples of alkali metal orthophosphates useful in the invention include tripotassium phosphate and trisodium phosphate. The terminology "alkaline earth metal", as used herein, refers to the Group IIA metallic elements, of the Periodic Table, viz., beryllium, magnesium, calcium, strontium, barium, and radium. An example of an alkaline earth metal orthophosphate useful in the invention is tribarium di(ortho)phosphate. The alkali metal and alkaline earth metal orthophosphates used in this invention preferably are compounds devoid of hydrogen atoms.

The coated abrasive products of this invention can make use of backings, make coats, abrasive grains, size coats, supersize coats, and optional adjuvants, such as grinding aids, fillers, and other additives, which are known or conventional in making coated abrasive products; such materials or substances and their forms and use are described, for example, in *Kirk-Othmer*, loc. cit. p. 17–37, McKetta, J. J., Cunningham, W. A., *Encyclopedia of Chemical Processing and Design*. Marcel Dekker, Inc., p. 1–19, and said U.S. Pat. Nos. 5,011,512 and 5,078,753, which descriptions are incorporated herein by reference.

The backing used as a base or substrate for the abrasive product of this invention generally will be made of a sheet or film of a material that is compatible with the make coat or abrasive slurry coat and other elements or components of the abrasive product and that is capable of maintaining its integrity during fabrication and use of the abrasive product. Examples of backing materials are paper, fiber, polymeric film, woven and nonwoven fabric or cloth, and vulcanized fibre. Specific weights, tensile strengths, and characteristics of some of such backings are set forth on p. 4 of the McKetta and Cunningham text, loc. cit. The backing may also contain a treatment or treatments to seal the backing, for example, to make them waterproof, and modify physical properties thereof. Still other examples of useful backings include U.S. Pat. No. 5,316,812 and European Patent Publication No. 0 619 769. Also, reference is made to U.S. Pat. No. 5,011,512 describing specific, woven, polyester cloth backings of certain weights and saturated with a calcium carbonate-filled latex/phenolic resin coating (useful also as a make coat). The backing may also have an attachment means on its back surface to secure the resulting coated abrasive to a support pad or back-up pad. This attachment means can be a pressure sensitive adhesive or a loop fabric for a hook and loop attachment. Alternatively, there may be a intermeshing attachment system as described in the said U.S. Pat. No. 5,201,101. The back side of the abrasive article may also contain a slip resistant or frictional coating. Examples of such coatings include an inorganic particulate (e.g., calcium carbonate or quartz) dispersed in an adhesive.

The binder used in the coated abrasive, such as a make, size or supersize coat, generally will be formed from a resinous binder or adhesive. This binder can also serve to bind the alkali or alkaline earth metal orthophosphate grinding aid to the coated abrasive. Additionally, the binder may serve to bond both the abrasive particles and the grinding aid particles to the backing. The resinous adhesive generally will be selected such that it has the suitable properties necessary for an abrasive article binder. Examples of typical resinous adhesives useful in this invention include thermosetting resins, such as phenolic resins, aminoplast resins having pendant a,b-unsaturated carbonyl groups, urethane resins, epoxy resins, ethylenically-unsaturated resins, acrylated isocyanurate resins, urea-formaldehyde resins, isocyanurate resins, acrylated urethane resins, acrylated epoxy resins, bismaleimide resins, fluorene modified epoxy resins, and mixtures thereof.

Epoxy resins useful as binders have an oxirane ring and are polymerized by the ring opening. Such epoxide resins include monomeric epoxy resins and polymeric epoxy resins. These resins can vary greatly in the nature of their backbones and substituent groups. For example, the backbone may be of any type normally associated with epoxy resins and substituent groups thereon can be any group free of an active hydrogen atom that is reactive with an oxirane ring at room temperature. Representative examples of acceptable substituent groups include halogens, ester groups, ether groups, sulfonate groups, siloxane groups, nitro groups and phosphate groups. Examples of some preferred epoxy resins include 2,2-bis[4-(2,3-epoxypropoxy)phenyl]propane (diglycidyl ether of bisphenol) and resins which are commercially available from Shell Chemical Co., Houston, Tex., under the trade designations "Epon 828", "Epon 1004", and "Epon 1001F"; and from Dow Chemical Co., Midland, Mich., under the trade designations "DER 331", "DER 332", and "DER 334". The mixing ratio of phosphate salt grinding aid to binder for the epoxy binder system based on solids weight is 1:10 to 5:1.0, preferably 1.5:1.0 to 4.0:1.0, and more preferably 2.0:1.0 to 3.0:1.0. Aqueous emulsions of the diglycidyl ether of bisphenol A have from about 50 to 90 wt. % solids, preferably 50 to 70 wt. % solids, and further comprise a nonionic emulsifier. An emulsion meeting this description is available from Shell Chemical Co., Louisville, Ky., under the trade designation "CMD 35201". Such aqueous epoxy emulsions are described as binder for grinding aids in EP 486308(Lee et al.), incorporated herein by reference. Other suitable epoxy resins include glycidyl ethers of phenol formaldehyde novolac (which are available from Dow Chemical Co., Midland, Mich., under the trade designations "DEN 431" and "DEN 438").

Phenolic resins are widely used in abrasive article binders because of their thermal properties, availability, cost and ease of handling. There are two types of phenolic resins, resole and novolac, and they can be used in this invention. Resole phenolic resins have a molar ratio of formaldehyde to phenol, of greater than or equal to 1:1, typically between 1.5: 1.0 to 3.0:1.0. Novolac resins have a molar ratio of formaldehyde to phenol of less than one to one. Examples of phenolic resins include those commercially available from Occidental Chemical Corp., Tonawanda, N.Y., under the trade designations "Durez" and "Varcum"; from Monsanto Co., St. Louis, Mo., under the trade designation "Resinox"; and from Ashland Chemical Inc., Columbus, Ohio, under the trade designations "Arofene" and "Arotap". Care must be taken with phenolic resins due to the water associated with phenolic resins and the hygroscopic nature of phosphate salts.

The aminoplast resins which can be used as binders have at least one pendant α,β-unsaturated carbonyl group per molecule or oligomer. These materials are further described in U.S. Pat. Nos. 4,903,440 and 5,236,472, of which descriptions are both incorporated herein by reference.

Ethylenically-unsaturated resins which can be used in this invention include both monomeric and polymeric compounds that contain atoms of carbon, hydrogen and oxygen, and optionally, nitrogen and the halogens. Oxygen or nitrogen atoms or both are generally present in ether, ester, urethane, amide, and urea groups. The ethylenically-unsaturated compounds preferably have a molecular weight of less than about 4,000 and are preferably esters made from the reaction of compounds containing aliphatic monohydroxy groups or aliphatic polyhydroxy groups and unsaturated carboxylic acids, such as acrylic acid, methacrylic acid, itaconic acid, crotonic acid, isocrotonic acid, maleic acid, and the like. Representative examples of ethylenically-unsaturated resins include those made by polymerizing methyl methacrylate, ethyl methacrylate, styrene, divinylbenzene, vinyl toluene, ethylene glycol diacrylate, ethylene glycol dimethacrylate, hexanediol diacrylate, triethylene glycol diacrylate, trimethylolpropane triacrylate, glycerol triacrylate, pentaerythritol triacrylate, pentaerythritol trimethacrylate, pentaerythritol tetraacrylate, or pentaerythritol tetramethacrylate, and mixtures thereof. Other ethylenically-unsaturated resins include those of polymerized monoallyl, polyallyl, and polymethallyl esters and amides of carboxylic acids, such as diallyl phthalate, diallyl adipate, and N,N-diallyladipamide. Still other polymerizable nitrogen-containing compounds include tris(2-acryloxyethyl)isocyanurate, 1,3,5-tri(2-methacryloxyethyl)-s-triazine, acrylamide, methylacrylamide, N-methylacrylarnide, N,N-dimethyl-acrylamide, N-vinylpyrrolidone, and N-vinylpiperidone.

Acrylated urethanes are diacrylate esters of hydroxy terminated isocyanate extended polyesters or polyethers. Examples of acrylated urethanes which can be used in the make coats of the present invention include those commercially available from Radcure Specialties, Inc., Atlanta, Ga., under the trade designations, "UVITHANE 782", "CMD 6600", "CMD 8400", and "CMD 8805". Acrylated epoxies which can be used in the make coats are diacrylate esters of epoxy resins, such as the diacrylate esters of bisphenol A epoxy resin. Examples of acrylated epoxies include those available from Radcure Specialties, Inc., Atlanta, Ga., under the trade designations, "CMD 3500", "CMD 3600", and "CMD 3700".

Bismaleimide resins which also can be used as binder are further described in U.S. Pat. No. 5,314,513 (Miller et al.), which description is incorporated herein by reference.

The binder for the alkali or alkaline earth metal orthophosphate salt grinding aid particles should be selected such that it is compatible with the orthophosphate salt. In general, certain orthophosphate salts (e.g., $K_3PO_4$) are hygroscopic and pH may be a significant factor. When the $K_3PO_4$ tends to absorb too much water, this then results in a non-homogenous binder that can be difficult to process. Thus, care should be taken to select the proper binder such that the orthophosphate salt is compatible which will result in a uniform binder that is easy to process.

The bond system of the abrasive article, viz. any of the make coat, size coat, or supersize coat, and the like, as applicable, also can contain adjuvants with the primary component thereof, i.e., the binder precursor optional additives, such as, for example, fillers (including grinding aids), fibers, lubricants, wetting agents, thixotropic materials, surfactants, pigments, dyes, antistatic agents, coupling agents, plasticizers, and suspending agents. The amounts of these materials are selected to provide the properties desired.

For example, although not required, other grinding aids, in addition to the alkali metal or alkaline earth metal orthophosphate present in the peripheral coating layer, can be used in the coated abrasive articles of the invention, if desired. A grinding aid is defined as particulate material that the addition of which has a significant effect on the chemical and physical processes of abrading which results in improved performance. In general, the addition of a grinding aid increases the useful life of the coated abrasive. Grinding aids encompass a wide variety of different materials and can be inorganic or organic based. Examples of chemical groups of grinding aids include waxes, organic halide compounds, halide salts and metals and their alloys. The organic halide compounds will typically break down during abrading and release a halogen acid or a gaseous halide compound. Examples of such materials include chlorinated waxes like tetrachloronaphthalene, pentachloronaphthalene, and polyvinyl chloride. Examples of halide salts include sodium chloride, potassium cryolite, sodium cryolite, ammonium cryolite, potassium tetrafluoroborate, sodium tetrafluoroborate, silicon fluorides, potassium chloride, magnesium chloride. Examples of metals include, tin, lead, bismuth, cobalt, antimony, cadmium, iron, and titanium. Other miscellaneous grinding aids include sulfur, organic sulfur compounds, graphite and metallic sulfides. It is also within the scope of this invention to use a combination of different grinding aids. The above mentioned examples of grinding aids is meant to be a representative listing of grinding aids, and it is not meant to encompass all grinding aids usable.

As another optional adjuvant for the make and/or size coats, a coupling agent can provide an association bridge between the binder precursor and the filler particles or abrasive particles. Examples of coupling agents include silanes, titanates, and zircoaluminates, and their manner of use for this function is described, for example, in U.S. Pat. No. 4,871,376 (DeWald). The abrasive bond preferably contains from about 0.01 to 3 wt. % coupling agent.

Since $K_3PO_4$, in particular, as the inorganic orthophosphate coating layer additive of the present invention, is difficult to incorporate into resin-bonded systems due to its hygroscopic nature, the present invention embodies improved techniques for incorporating $K_3PO_4$ into a binder. $K_3PO_4$ has the common names of tripotassium phosphate or tertiary potassium (ortho)phosphate. The physical nature of $K_3PO_4$ is that it is colorless, rhombic, and deliquescent. When a water-soluble solid, such as $K_3PO_4$, acquires sufficient water of hydration it will dissolve in the water and form a solution. Anhydrous forms of $K_3PO_4$ are commercially available, for example, from Aldrich Chemical Co., Milwaukee, Wis. However, upon exposure to moisture, such as air moisture, the $K_3PO_4$ takes on water of hydration as explained above.

One improved technique discovered by the present inventors for incorporating $K_3PO_4$ into a binder involves an aqueous system where the tripotassium phosphate is incorporated into an acrylic/latex binder system. The general procedure involves heating an excess of $K_3PO_4$ in water, decanting off the solute, and cooling to give a solution.

Then, the solution of $K_3PO_4$ is blended with an acrylic resin latex at approximately room temperature (about 25° C.) in a ratio, by weight, of about 1:10 to about 5:1, respectively. On a dry weight/weight basis, the ratio of $K_3PO_4$ to acrylic latex solids used in a coating generally should be about 2:3 to about 3:2, preferably about 5.5:4.5. If the mixing ratio of $K_3PO_4$ to acrylic latex becomes too large, the formulation can become difficult to coat and insufficient acrylic resin might be present to fully cover the $K_3PO_4$ to prevent it from picking up air moisture when part of the coated abrasive article. On the other hand, if the weight ratio of $K_3PO_4$ to acrylic latex becomes too small, the amount of $K_3PO_4$ becomes inadequate to provide the desired grinding benefit. The optimal mixing ratio of $K_3PO_4$ to acrylic latex can be determined empirically in a straightforward manner with above guidance. An acrylic latex should be chosen which does not salt out (coagulate) upon addition of the phosphate solution. Exemplary of a usable acrylic latex is an amine functional acrylic polymer having 46% solids with the trade designation "XA5107", or an acrylic latex having the trade designation "A5102", both commercially available from Zeneca Division of ICI America, Wilmington, Mass.

To accomplish the blending of the $K_3PO_4$ and acrylic latex, $K_3PO_4$ should be added slowly with light mixing, or, alternatively, under vigorous mixing conditions, to the acrylic latex until the weight of $K_3PO_4$ is about 20% of the weight of the acrylic resin latex. At this point, the remainder of the $K_3PO_4$ can be added rapidly with mixing to the acrylic latex at any rate, even all at once.

For the slow addition at light mixing conditions, the $K_3PO_4$ addition to the acrylic latex generally should be spread over about 1.5 minutes with substantially a constant rate of addition until the weight of $K_3PO_4$ is about 20% of the weight of the acrylic resin latex. At this point, the remainder of the $K_3PO_4$ can be added rapidly with mixing to the latex at any rate, even all at once.

For the alternative approach using vigorous mixing conditions, such mixing conditions can be achieved by use of high shear mixing, such as with an air mixer. For example, such high shear mixing can involve a two inch stainless steel blade rotating at least at 360 rpm in the mixture of contents contained in a container. When using vigorous mixing conditions, the addition rate is substantially uniform and at a rate where the weight of $K_3PO_4$ reaches about 20% of the weight of the acrylic resin latex mixing ratio in about 10 to 15 seconds. At this point, the remainder of the $K_3PO_4$ can be added rapidly with mixing to the latex at any rate, even all at once. Other adjuvants optionally can be added as well to the coating formulation, such as filler (e.g., $CaCO_3$), colorants (such as red iron oxide), and so forth.

After complete addition of the inorganic phosphate to the acrylic latex resin, the mixture can be coated upon a coated abrasive article by coating techniques such as roll coating or spray coating. The roll coater can be a single roll coater, e.g. a coating roll of 60 Shore A durometer with a metal back-up roll, forming a nip with a soft opposing roll. Drying of the coating containing the inorganic phosphate and acrylic latex binder can be accomplished by air drying overnight at room temperature or oven drying at 60° C. for about 1.5 to 3 hours. Drying of the coating is deemed complete when the coating is not wet to the touch and has "skinned-over", typically where the dry weight of the coating becomes about 25% the original wet weight of the coating. The dried layer, as incorporated into a coated abrasive, such as a peripheral coating, is used in a dry grinding system because water will destroy (dissolve) the coating.

Another technique of the invention for successfully incorporating $K_3PO_4$ into a coating binder, involves the addition of the $K_3PO_4$ solid particles to a non-aqueous (anhydrous) organic solvent-based epoxy resin system. In this technique, the epoxy resin first is dissolved in an anhydrous organic solvent in a ratio generally of about 1:2 to about 1:4, respectively, on a weight basis, preferably approximately 1:3. Usable solvent includes a xylene-containing aromatic hydrocarbon blend solvent, such as that having the trade designation "AROMATIC 100", commercially available from Worum Chemical Co., Saint Paul, Minn. The epoxy resin preferably is a diglycidyl ether of bisphenol A epoxy resin coatable from an anhydrous organic solvent. An epoxy resin of this type includes those having the trade designation "EPON 828", having an epoxy equivalent weight ranged from about 185 to about 195, which is commercially available from Shell Chemical Co., Houston, Tex. Optionally, a conventional inorganic anhydrous thickener is added to the mixture, such as colloidal or fumed silica, to maintain a total coating mixture viscosity in the range of about 2,500 to 5,000 cps, as measured on a Brookfield viscometer, having a #2 spindle and run at 6 rpm at room temperature (about 25° C.). The silica thickener includes colloidal fumed silicas such as that having the trade designation "Cab-O-Sil M-5" (40 to 100 micrometers in diameter), commercially available from Cabot Corp., Tuscola, Ill. Also, an amine curative for the epoxy should be added, which preferably is not an acidic curative to avoid reaction with the inorganic phosphate. An example of a useful amine curative in this regard is a polyamide curing agent, commercially available from Henkel Corp., Cincinnati, Ohio, under the trade designation "VERSAMID 125". Other adjuvants optionally can be added as well, colorants (such as red iron oxide), filler (e.g., $CaCO_3$), and so forth.

The alkali metal or alkaline earth metal orthophosphate, e.g., $K_3PO_4$, is added to the premixture of anhydrous organic solvent and the epoxy resin at vigorous mixing conditions such as mixing conditions achieved by use of high shear mixing, such as with an air mixer. The $K_3PO_4$ here, unlike in the acrylic latex system described herein, is not treated to acquire more water of hydration before addition to the organic solvent and epoxy resin, and preferably is in anhydrous form, such as commercially available, for example, from Aldrich Chemical Co., Milwaukee, Wis. The $K_3PO_4$ generally is used in a particle diameter in the range of from about 30 to about 200 micrometers. If the $K_3PO_4$ is too large in particle sizing, it can be crushed using a high speed blender for a few seconds to satisfy this general range. The high shear mixing can involve a two inch stainless steel blade rotating at least at 360 rpm in the mixture contents as contained in a container. In this embodiment, there is no need to slowly add the inorganic phosphate to the resin for a portion of the addition period. In fact, it is preferable to add the inorganic phosphate into the resin and solvent at once to avoid any additional water pick-up by the $K_3PO_4$. The ratio of $K_3PO_4$ to epoxy resin generally is about 4:1 to about 6:1, respectively, on a weight basis.

An example of a usable formulation of $K_3PO_4$ and the epoxy resin/anhydrous organic solvent system includes about 25 to 30% anhydrous organic solvent such as xylene and/or other aromatic hydrocarbons; about 1 to 2% colloidal or fumed silica thickener; about 8 to 12% epoxy resin such as a diglycidyl ether of bisphenol A epoxy resin; about 6 to 8% epoxy resin curative such as a polyamide curing agent; about 45 to 55% $K_3PO_4$, and the balance being optional adjuvants such as 2 to 3% colorant (e.g., iron oxide), all percentages being by weight. These types of formulations tend to have a pot life of about 3 to 4 hours at room temperature. The percentage of $K_3PO_4$ generally represents between about 50% to 85% of the mixture on a solids basis. At lower amounts of $K_3PO_4$, additional thickener may be required to maintain a total coating mixture viscosity in the desired range of about 2,500 to 5,000 cps, as measured on a Brookfield viscometer, having a #2 spindle and run at 6 rpm at room temperature (about 25° C.).

The $K_3PO_4$ and epoxy resin formulation, as combined, can be coated upon a coated abrasive article by coating techniques such as roll coating or spray coating. The roll coater can be a single roll coater, e.g. a coating roll of 60 Shore A durometer with a metal back-up roll, forming a nip with a soft opposing roll. Drying of the coating containing the inorganic phosphate and epoxy resin binder can be accomplished by oven curing at 100° C. for about 2.5 hours. These drying/curing conditions are also dependent upon the chemistry of the binder. The dried layer, as incorporated into a coated abrasive, such as a peripheral coating, is used in a dry grinding system because water will destroy (dissolve) the coating.

The abrasive particles to be used in this invention typically have a particle size ranging from about 0.1 to 1500 micrometers, usually between about 0.1 to 500 micrometers. It is preferred that the abrasive particles have a Mohs' hardness of at least about 8, more preferably above 9. Examples of such abrasive particles include fused aluminum oxide (which includes brown aluminum oxide, heat treated aluminum oxide, and white aluminum oxide), ceramic aluminum oxide, green silicon carbide, silicon carbide, chromia, alumina zirconia, diamond, iron oxide, ceria, cubic boron nitride, boron carbide, garnet, and combinations thereof The term "abrasive particles" or "abrasives grains" also encompasses single abrasive particles bonded together to form an abrasive agglomerate. Abrasive agglomerates are described in U.S. Pat. Nos. 4,311,489; 4,652,275; and 4,799,939; which descriptions are incorporated herein by reference. In some instances, it is preferred that the agglomerate grains be the same size or about the same size as the abrasive grains.

Examples of ceramic aluminum oxide abrasive grains include those disclosed in U.S. Pat. Nos. 4,314,827; 4,518,397; 4,574,003; 4,623,364; 4,744,802; 4,770,671; 4,881,951; 5,011,508; 5,291,591; 5,201,916; and 5,304,331; and EP publication 228,856. Examples of fused alumina zirconia abrasive grains include those disclosed in U.S. Pat. Nos. 3,781,408 and 3,893,826.

It is also within the scope of this invention to have a surface coating on the abrasive grains. The surface coating may have many different functions. In some instances the surface coatings increase adhesion to the binder or alter the abrading characteristics of the abrasive grain or particle. Examples of surface coatings include coupling agents, halide salts, metal oxides such as silica, refractory metal nitrides, and refractory metal carbides.

It is within the scope of this invention to have (1) coated agglomerate grains along side of abrasive grains (i.e., agglomerate grains are between abrasive grains); (2) agglomerate grains coated underneath abrasive grains; (3) agglomerate grains coated over abrasive grains; and (4) combinations thereof The abrasive grains of this invention also can embrace abrasive particles mixed or agglomerated with each other or diluent particles. The particle size of these diluent particles preferably is on the same order of magnitude as the abrasive grains or particles. Examples of such diluent particles include gypsum, marble, limestone, flint, silica grinding aids, glass bubbles, glass beads, aluminum silicate, and the like.

The manipulative steps of the process for making the coated abrasive articles of the invention can be essentially the same as those currently practiced in the art. Coated abrasives generally consist of a backing, abrasive grains, and at least one binder to hold the abrasive grains to the backing. The backing typically is saturated with a saturant coat precursor by any conventional technique such as dip coating, roll coating, powder coating, or hot melt coating. For purposes of making the coated abrasive article of this invention, not only the saturant coat precursor, but also the backsize coat precursor, the presize coat precursor, the make coat precursor, the size coat precursor, and the supersize precursor, are each fully cured, or at least either dried or partially cured after application to an extent such that the coating is dry to the touch before the next coat is applied. After the last coat is applied, and if necessary, the remaining partially cured coats are fully cured.

After the saturant coat is applied, the backsize or presize coat precursors are applied by any conventional technique such as spray coating, roll coating, die coating, powder coating, hot melt coating or knife coating. The coated abrasive then comprises providing on the saturated and sized backing a first bond system, commonly referred to as the make coat, on the front side of the backing. The make coat is applied in a liquid or flowable form to the front side of the backing. Then, abrasive particles are at least partially embedded into the make resin by conventional projection techniques, such as by a electrostatic coating process, before the make coat is partially dried or cured. The make coat is then partially dried or cured, and a second bond system is applied over the make coated abrasive particles, commonly referred to as a size coating. The size coat is applied in a liquid or flowable form over the abrasive grains and make coat. The size coat, and if still necessary, the make coat, are then fully cured. Notably, if a thermoplastic resin is used alone for any bond system, the thermoplastic resin can be dried in order to solidify. Thus, for the purpose of this application, the term "cure" refers to the polymerization, gelling, or drying procedure necessary to convert a binder precursor into a binder. Therefore, "at least partially curing" refers to at least partially polymerizing, gelling, or drying a binder precursor.

The make and size coats can be applied by any number of techniques such as roll coating, spray coating, curtain coating, and the like. In some instances, a third coating or a supersize coat is applied over the size coat by conventional techniques. The make, size, and supersize coats can be cured either by drying or the exposure to an energy source such as thermal energy, or radiation energy including electron beam, ultraviolet light and visible light. The choice of the energy source will depend upon the particular chemistry of the resinous adhesive. General methods for making the coated abrasive articles of this invention are described in U.S. Pat. Nos. 4,734,104 and 4,737,163, which are incorporated herein by reference.

The abrasive products of the present invention are not limited as to the types of workpiece that can be abraded therewith. By "abrading", the term as used herein generally can mean any of grinding, polishing, finishing, and the like. The workpiece surfaces made of wood, metal, metal alloy, plastic, ceramic, stone, and the like, can be abraded by the coated abrasive products of the present invention. The abrasive products of this invention are particularly well-suited for difficult to abrade metal grinding operations, especially titanium grinding.

Also, the coated abrasive products of the present invention can be readily converted into various geometric shapes to suit the contemplated application, such as discrete sheets, disc forms, endless belt forms, conical forms, and so forth, depending on the particular abrading operation envisioned.

While a coated abrasive article embodiment of the invention has been described in detail herein for illustrative purposes, the invention also encompasses other types of abrasive articles such as a bonded abrasive article, and abrasive articles using abrasive agglomerates, and nonwoven abrasive articles, each of which contain an inorganic alkali or alkaline earth metal orthophosphate in a surface region thereof. The bonded abrasive articles comprise a shaped mass of the abrasive particles and an alkali metal or alkaline earth metal orthophosphate adhered together with a binder, which can be an organic, metallic or vitrified binder. By way of example, the shaped mass can be in the forms of a grinding wheel or a conical shape.

In another aspect of the invention, abrasive particles are used in an abrasive article, such as a coated abrasive, in the form of erodible abrasive agglomerates where composite abrasive particles are formed of alkali metal or alkaline earth metal orthophosphate and abrasive grains adhered together with a binder. Known methods, such as described in U.S. Pat. Nos. 4,311,489, 4,652,275, 4,799,939, incorporated herein by reference, can be used to make the bonded abrasives and erodible agglomerates of this invention with the modification of adding the inorganic metal orthophosphate. Thermosetting binders, such as those described supra, are preferred for adhering the inorganic metal orthophosphate grinding aid particles together in the agglomerates.

The alkali metal or alkaline earth metal orthophosphate, and/or as included in erodible agglomerates, also can be incorporated into lofty, open nonwoven abrasive articles, such as those prepared according to the teachings of U.S. Pat. Nos. 2,958,593, 4,991,362, and 5,025,596, all of which are hereby incorporated by reference. In general, nonwoven abrasives include open, lofty, three-dimensional webs of organic fibers bonded together at points where they contact by an abrasive binder. These webs may be roll coated, spray coated, or coated by other means with binder precursor compositions including the alkali or alkaline earth metal orthophosphate, and/or agglomerates including same, and subsequently subjected to conditions sufficient to cure the resin.

In the following examples, objects and advantages of this invention are further illustrated by various embodiments thereof but the details of those examples should not be construed to unduly limit this invention. All parts and percentages therein are by weight unless otherwise indicated.

Test Procedure I

The coated abrasive material made by the examples herein were converted into 203 cm by 7.6 cm continuous belts and were installed on a Thompson Type C12 grinding machine. The effective cutting area of the abrasive belt was 2.54 cm by 203 cm. The workpiece abraded by these belts was titanium, 2.54 cm width by 17.78 cm length by 10.2 cm height. Abrading was conducted along the 2.54 cm by 17.78 face. The workpiece was preweighed and then mounted on a reciprocating table. The speed of the abrasive belt was 610 surface meters per minute. The table speed, at which the workpiece traversed, was 6.1 meters per minute. The downfeed increment of the abrasive belt was 0.0025 to 0.0127 cm/pass of the workpiece. The process used was conventional surface grinding wherein the workpiece was reciprocated beneath the rotating abrasive belt with incremental downfeeding between each pass. This grinding was carried out dry. However, as the workpiece exited the grinding interface, on each pass, it was flooded with water to cool it followed by a blast of cool air to dry the workpiece before re-entry into the grinding interface. Each belt was used until it shelled. Then the workpiece was reweighed, and the difference between the initial weight and the final weight representing the total cut of the belt. Shelling is the premature release of the abrasive particles; shelling generally marks the end of the useful life of the belt and can be detected on that basis.

Specific energy, $E_s$, was determined for some of the examples. Specific energy, $E_s$, is the amount of energy required to remove a unit volume of material (i.e., $J/mm^3$). A better performing coated abrasive will have lower specific energies of grinding. $E_s$ is calculated by multiplying the cutting force (tangential grinding force) by the belt speed and then dividing by the material removal rate.

Materials

The materials indicated in the examples herein have following meanings:

Epoxy resins

BPAW: a composition containing a diglycidyl ether of bisphenol A epoxy resin coatable from water containing approximately 60% solids and 40% water. This composition, having the trade designation "CMD 35201", was commercially obtained from Shell Chemical Co., Louisville, Ky. This composition also contained a nonionic emulsifier. The epoxy equivalent weight ranged from about 600 to about 700.

BPAS: a composition containing a diglycidyl ether of bisphenol A epoxy resin coatable from an organic solvent. This composition, having the trade designation "EPON 828", was commercially obtained from Shell Chemical Co., Houston, Tex.

Acrylic binder

ACR: amine functional acrylic polymer having 46% solids in water, having the trade designation "XA5107", was commercially obtained from Zeneca Division of ICI America, Wilmington, Mass.

Phenolic resin

RPI: a resole phenolic resin with 75% solids (nonvolatile)

Curing agents

EMI: 2-ethyl-4-methyl imidazole. This curing agent, having the trade designation "EMI-24", was commercially obtained from Air Products, Allentown, Pa.

PA: a polyamide curing agent, having the trade designation "Versamid 125", was commercially obtained from Henkel Corporation, Cincinnati, Ohio.

Grinding Aids $KBF_4$: 98% pure micropulverized potassium tetrafluoroborate, in which a 95% fraction by weight passes through a 325 mesh screen and a 100% fraction by weight passes through a 200 mesh screen.

PVC: polyvinyl chloride which had the trade designation "GEON 103EPF-76", was commercially obtained from the Specialty Polymers & Chemicals Div. of B. F. Goodrich of Cleveland, Ohio.

$K_3PO_4$: anhydrous tripotassium (ortho)phosphate, was commercially obtained from Aldrich Chemical Co., Milwaukee, Wis.

$Na_3PO_4$: trisodium (ortho)phosphate tribasic dodecahydrate, was commercially obtained from EM Science, Gibbstown, N.J.

$Ba_3(PO_4)_2$: tribarium di(ortho)phosphate, was commercially obtained from Alpha Inorganics, Inc., Beverly, Mass.

Additives

IO: iron oxide

Thixotropic Thickener

CAB M5: a colloidal silica having the trade designation "Cab-O-Sil M-5", was commercially obtained from Cabot Corp., Tuscola, Ill.

Dispersing agent

AOT: a dispersing agent, i.e. sodium dioctyl sulfosuccinate, having the trade designation "Aerosol OT", was commercially obtained from Rohm & Haas Company, Philadelphia, Pa.

Solvent

WC100: an aromatic hydrocarbon solvent, having the trade designation "AROMATIC 100", was commercially obtained from Worum Chemical Co., St. Paul, Minn.

HP: a mixture of 85% 2-methoxy propanol and 15% $H_2O$, commercially obtained from Worum Chemical Co., St. Paul, Minn.

General Procedure for Making Coated Abrasives (Belts)

For the following examples, coated abrasive belts were made as follows. The backing of each coated abrasive was a Y weight woven polyester cloth which had a four over one weave. Each backing was saturated with a latex/phenolic resin and then placed in an oven to partially cure this resin. Next, a calcium carbonate-filled latex/phenolic resin pretreatment coating was applied to the back side of each backing. Each coated backing was heated to approximately 120° C. and maintained at this temperature until the resin had cured to a tack-free state. Finally, a pretreatment coating of latex/phenolic resin was applied to the front side of each coated backing and each coated backing was heated to approximately 120° C. and maintained at this temperature until the resin had precured to a tack-free state. Each backing made by this procedure was completely pretreated and was ready to receive a make coat.

A coatable mixture for producing a make coat for each coated backing was prepared by mixing 69 parts of 70% solids phenolic resin (48 parts phenolic resin), 52 parts non-agglomerated calcium carbonate filler (dry weight basis), and an adequate amount of a solution comprised of 90 parts water/10 parts ethylene glycol monoethyl ether to form a make coat in each case which was 84% solids. This coatable mixture was applied to the backing with a wet coating weight of 194 g/m$^2$. The make coat was applied in each case via a knife coating technique.

Next, grade 60 (ANSI standard B74.18 average particles size of 286 micrometers) silicon carbide abrasive particles were electrostatically coated onto the uncured make coat with a weight of 527 g/m$^2$. Then the resulting constructions received a precure of 3 hours at 100° C.

A 82% solids coatable mixture suitable for forming a size coat was then applied over the abrasive particles/make coat construction via two-roll coater. A 82% solids coatable mixture suitable for forming a size coat consisting of 32% RPI, 50.2% CRY, 1.5% IO, and 16.3% HP, was then applied over the abrasive particles/make coat construction via a two-roll coater. The wet size coating weight in each case was about 350 g/m$^2$. The resulting coated abrasives received a thermal cure of 30 minutes at 88° C. followed by 12 hours at 100° C.

Where indicated in the following examples, a supersize coat was then applied. Where applied, the supersize coat was applied by roll coating followed by curing at 100° C. for 90 minutes. Specific details of the supersize compositions are provided below in the procedure for each abrasive example.

After thermal cure, the coated abrasives were single flexed (i.e., passed over a roller at an angle of 90° C. to allow a controlled cracking of the make coat, the size coat, and any supersize coat), then converted into 7.6 cm by 203 cm coated abrasive belts.

EXAMPLE 1 and COMPARATIVE EXAMPLE A

The coated abrasives for Example 1 and Comparative Example A were made according to the General Procedure for Making Coated Abrasives. These examples compared the abrading characteristics of coated abrasive articles of this invention including an alkali metal phosphate salt, viz., tripotassium phosphate, in the supersize versus a comparative example using a conventional grinding aid, viz., potassium tetrafluoroborate, in the supersize. Comparative Example A was supersized at a coating rate of 193 g/m$^2$ with the composition as follows: 29.2% BPAW, 035% EMI, 53.3 $KBF_4$, 14.1% water, 0.75% AOT, and 2.3% IO.

Example 1 was supersized with the following composition using a weight of 193 g/m$^2$: 29.2% BPAW, 0.35% EMI, 53.3% $K_3PO_4 \cdot 7H_2O$, 14.1% water, 0.75% AOT, and 2.3% IO.

The Test Procedure I was utilized to test these examples and the performance results are tabulated in Table 1.

TABLE 1

| SAMPLE | GRINDING AID IN SUPERSIZE | TOTAL CUT (g) |
|---|---|---|
| Comp. Ex. A | $KBF_4$ | 138.9 |
| Example 1 | $K_3PO_4.7H_2O$ | 99.9 |

This example serves to illustrate that not all grades of coated abrasives and/or grinding conditions will be improved on grinding titanium with the additions of $K_3PO_4$ in a water-based epoxy supersize.

EXAMPLE 2 and COMPARATIVE EXAMPLES B–D

The coated abrasives for Example 2 and Comparative Examples B–D were made according to the General Procedure for Making Coated Abrasives except the make coat was applied at a coating weight of 130 g/m$^2$ (wet); grade 80 silicon carbide was applied to the make coat at 340 g/m$^2$; and the size coat was applied at 250 g/m$^2$ (wet). A wax formulation, either alone or with a grinding aid indicated herein, in cooled solidified form, was applied peripherally to the abrasive belt during grinding. The Comparative Example B was a control having no wax formulation peripheral coating applied. Comparative Example C was peripherally coated with a stick comprised of CALWAX 252-B wax alone. Comparative Example D was made by peripherally coating the abrasive belt with a wax stick formed by mixing equal parts by weight of $KBF_4$ grinding aid and polyvinyl chloride (PVC) with CALWAX 252-B. Example 2 was made by peripherally coating the abrasive belt with a wax stick formed by mixing $K_3PO_4$ with CALWAX 252-B. The abrasive belts were tested according to Test Procedure I.

The results are summarized in Table II.

TABLE II

| SAMPLE | PERIPHERAL COATING | TOTAL CUT (g) | SPECIFIC ENERGY ($E_s$) (Joules/mm$^2$) |
|---|---|---|---|
| Comp. Ex. B | None | 42 | 71.5 |
| Comp. Ex. C | Wax alone | 29.1 | 93.4 |
| Comp. Ex. D | Wax/$KBF_4$/PVC | 67.7 | 37.1 |
| Example 2 | Wax/$K_3PO_4$ | 74.4 | 35.5 |

The coated abrasive belt of Example 2 demonstrated the highest total cut values, and lowest specific energy values, i.e. the lowest energy required for grinding.

EXAMPLES 3–4 and COMPARATIVE EXAMPLE E

The coated abrasives for Examples 3–4 and Comparative Example E were made according to the General Procedure for Making Coated Abrasives except the make coat was applied at a coating weight of 233 g/m$^2$ (wet); grade 40 silicon carbide was applied to the make coat at 909 g/m$^2$; the size coat was applied at 465 g/m$^2$ (wet); and the supersize coats had the following details. An aqueous supersize was applied at a wet coating weight of 348 g/m$^2$ to the coated abrasive belt of Comparative Example E having a composition identical to the supersize for Comparative Example A. The supersize for Example 3 was the same as that of Comparative Example E except the grinding aid additive was $K_3PO_4$. Example 4 had a supersize of the following composition: 11.2% BPAS, 7.5% PA, 50.4% $K_3PO_4$, 28.0% WC100, 2.9% IO. Test Procedure I was used to test the performance of these examples and the results are summarized in Table III.

TABLE III

| SAMPLE | GRINDING AID | TOTAL CUT (g) | SPECIFIC ENERGY ($E_s$) (Joules/mm$^2$) |
|---|---|---|---|
| Comp. Ex. E | $KBF_4$ | 262.1 | 83.5 |
| Ex. 3 | $K_3PO_4$ | 274.6 | 44.8 |
| Ex. 4 | $K_3PO_4$ | 308.0 | 45.9 |

The coated abrasive belts of Examples 3–4 demonstrated higher total cut values, and significantly lower specific energy values, i.e. lower energy was required for grinding, as compared to Comparative Example E using conventional $KBF_4$ supersize grinding aid.

EXAMPLES 5–8 and COMPARATIVE EXAMPLE F

The coated abrasives for Examples 5–8 and Comparative Example F were made according to the General Procedure for Making Coated Abrasives except the make coat was applied at a coating weight of 200 g/m$^2$ (wet); grade 100 silicon carbide was applied to the make coat at 402 g/m$^2$; the size coat was applied at 230 g/m$^2$ (wet); and a supersize coat was applied at 215 g/m$^2$. The supersize for Comparative Example F had the same composition as the supersize composition to that of Comparative Example A. The supersize for Example 5 was the same as that of Example 4. For Example 6, the supersize composition was 50% ACR/50% $K_3PO_4$. The supersize composition of Example 7 was 50% ACR/50% $Ba_3(PO_4)_2$, and the supersize composition of Example 8 was 50% ACR/50% $Na_3PO_4 \cdot H_2O$. Test Procedure I was used to test the performance of these examples and the results are summarized in Table IV.

TABLE IV

| SAMPLE | GRINDING AID | TOTAL CUT (g) | SPECIFIC ENERGY ($E_s$) (Joules/mm$^3$) |
|---|---|---|---|
| Comp. Ex. F | $KBF_4$ | 240 | 86.3 |
| Ex. 5 | $K_3PO_4$ | 250 | 83.5 |
| Ex. 6 | $K_3PO_4$ | 227 | 56.8 |
| Ex. 7 | $Ba_3(PO_4)_2$ | 195 | 108.7 |
| Ex. 8 | $Na_3PO_4.H_2O$ | 168 | 125.3 |

EXAMPLES 9–13 and COMPARATIVE EXAMPLES G–H

The coated abrasives for Examples 9–13 and Comparative Examples G and H were made according to the General Procedure for Making Coated Abrasives except the make coat was applied at a coating weight of 117 g/m$^2$ (wet; grade 100 silicon carbide was applied to the make coat at 242 g/m$^2$; the size coat was applied at 150 g/m$^2$ (wet); and a supersize coat was applied at 130 g/m$^2$.

The supersize coats of Examples 9–12 and Comparative Example G used the following composition: 11.2% BPAS, 7.5% PA, 50.4% of the grinding aid(s) in the weight % ratio indicated in Table V, 28.0% WC100, 2.9% IO. Comparative Example H was the same as Comparative Example G except it omitted the grinding aid component. Test Procedure I was used to test the performance of these examples and the results are summarized in Table V.

TABLE V

| SAMPLE | GRINDING AID $KBF_4/K_3PO_4$ | TOTAL CUT (g) | SPECIFIC ENERGY ($E_s$) (Joules/mm$^3$) |
|---|---|---|---|
| Comp. Ex. G | 100/0 | 298 | 109 |
| Ex. 9 | 75/25 | 386 | 88 |
| Ex. 10 | 50/50 | 284 | 75 |
| Ex. 11 | 25/75 | 276 | 111 |
| Ex. 12 | 0/100 | 384 | 56 |
| Comp. Ex. H | None | 191 | 34 |

EXAMPLES 13–14 and COMPARATIVE EXAMPLE I

The coated abrasives for Examples 13–14 and Comparative Example I were made according to the General Procedure for Making Coated Abrasives except the make coat was applied at a coating weight of 142 g/m$^2$ (wet); grade 100 silicon carbide was applied to the make coat at 602 g/m$^2$; the size coat was applied at 130 g/m$^2$ (wet); and a supersize composition for Comparative Example G. The supersize composition of Example 13 was the same as that of Example 9. The supersize composition of Example 14 was the same as that of Example 12. Test Procedure I was used to test the performance of these examples and the results are summarized in Table VI.

TABLE VI

| SAMPLE | GRINDING AID $KBF_4/K_3PO_4$ | TOTAL CUT (g) | SPECIFIC ENERGY ($E_s$) (Joules/mm$^3$) |
|---|---|---|---|
| Comp. Ex. I | 100/0 | 162 | 123 |
| Ex. 13 | 75/25 | 188 | 90 |
| Ex. 14 | 0/100 | 270 | 66 |

Various modifications and alterations of this invention will become apparent to those skilled in the art from the foregoing description without departing from the scope of spirit of this invention.

What is claimed is:

1. A coated abrasive article comprising a substrate having a plurality of abrasive particles adherently bonded thereto by a binding material, and a peripheral coating layer comprising a non-aqueous thermoset binder and an inorganic metal phosphate salt devoid of hydrogen selected from the group consisting of an alkali metal orthophosphate salt and an alkaline earth metal orthophosphate salt, wherein the thermoset binder forms a substantially continuous medium by which the inorganic metal phosphate salt is attached.

2. The coated abrasive article of claim 1, wherein said peripheral coating layer is selected from the group consisting of a size coat and a supersize coat.

3. The coated abrasive article of claim 1, wherein said binder is selected from the group of thermosetting resins consisting of phenolic resins, aminoplast resins having pendant α-β-unsaturated carbonyl groups, urethane resins, epoxy resins, ethylenically-unsaturated resins, acrylated isocyanurate resins, urea-formaldehyde resins, isocyanurate resins, acrylated urethane resins, acrylated epoxy resins, bismaleimide resins, and mixtures thereof.

4. The coated abrasive article of claim 1, wherein said inorganic metal phosphate salt is selected from the group consisting of tripotassium orthophosphate, trisodium orthophosphate, and tribarium di(ortho)phosphate.

5. The coated abrasive article of claim 1, wherein said inorganic metal phosphate salt is tripotassium orthophosphate.

6. The coated abrasive article of claim 1, wherein said inorganic metal phosphate salt is trisodium orthophosphate.

7. The coated article of claim 1, wherein said inorganic metal phosphate salt is tribarium di(ortho)phosphate.

8. The coated abrasive article of claim 1, wherein said peripheral coating further comprises potassium tetrafluoroborate.

9. A coated abrasive article comprising a substrate having a plurality of abrasive particles adherently bonded thereto by a binding material, and a peripheral coating layer comprising an anhydrous thermoset binder system and an inorganic metal phosphate salt devoid of hydrogen selected from the group consisting of alkali metal orthophosphate salt and an alkaline earth metal orthophosphate salt, wherein the binder system is cured at a temperature of at least about 100° C. for a time sufficient to form the peripheral coating layer.

10. The coated abrasive article of claim 9, wherein the peripheral coating layer is selected from the group consisting of a size coat and a supersize coat.

11. The coated abrasive article of claim 9, wherein the optional additive is selected from the group consisting of fillers, fibers, lubricants, wetting agents, thixotropic materials, surfactants, pigments, dyes, antistatic agents, coupling agents, plasticizers, suspending agents, and mixtures thereof.

12. The coated abrasive article of claim 9, wherein the anhydrous thermoset binder system comprises an epoxy resin.

13. The coated abrasive article of claim 9 wherein the peripheral coating layer is formed from an anhydrous binder system comprising an inorganic metal phosphate salt devoid of hydrogen selected from the group consisting of an alkali metal orthophosphate salt and an alkaline earth metal orthophosphate salt and an epoxy resin, wherein the inorganic metal phosphate salt is not treated to acquire water of hydration prior to its addition to the anhydrous binder system.

14. The coated abrasive article of claim 9, wherein the inorganic metal phosphate salt is selected from the group consisting of tripotassium orthophosphate, trisodium orthophosphate, and tribarium di(ortho)phosphate.

* * * * *

UNITED STATES PATENT AND TRADEMARK OFFICE

CERTIFICATE OF CORRECTION

PATENT NO. : 5,961,674
DATED : October 5, 1999
INVENTOR(S) : John J. Gagliardi and Charles H. Houck It is certified that error appears in the above-identified patent and that said Letters Patent is hereby corrected as shown below:

Column 3,
Line 6, "barium salts thereof Phosphorus" should be -- barium salts thereof. Phosphorus --

Column 14,
Line 8, "combinations thereof" should be -- combinations thereof. --

Signed and Sealed this

Fourth Day of December, 2001

*Attest:*

Nicholas P. Godici

*Attesting Officer*

NICHOLAS P. GODICI
*Acting Director of the United States Patent and Trademark Office*